US011648516B2

(12) United States Patent
Zhang et al.

(10) Patent No.: US 11,648,516 B2
(45) Date of Patent: May 16, 2023

(54) OZONE WATER GENERATING DEVICE

(71) Applicant: Xiamen Forbetter Sanitary Ware Co., Ltd., Fujian (CN)

(72) Inventors: Xingui Zhang, Xiamen (CN); Yihui Chen, Xiamen (CN); Mouyong Lin, Xiamen (CN)

(73) Assignee: XIAMEN FORBETTER SANITARY WARE CO., LTD., Fujian (CN)

( * ) Notice: Subject to any disclaimer, the term of this patent is extended or adjusted under 35 U.S.C. 154(b) by 274 days.

(21) Appl. No.: 17/073,416

(22) Filed: Oct. 19, 2020

(65) Prior Publication Data

US 2022/0118411 A1 Apr. 21, 2022

(51) Int. Cl.

| | |
|---|---|
| ***B01F 3/04*** | (2006.01) |
| ***B01F 23/232*** | (2022.01) |
| ***B01F 25/31*** | (2022.01) |
| ***B01F 35/21*** | (2022.01) |
| ***B01F 35/22*** | (2022.01) |
| ***B01F 35/71*** | (2022.01) |
| *B01F 23/237* | (2022.01) |
| *B01F 101/48* | (2022.01) |

(52) U.S. Cl.

CPC ..... *B01F 23/232* (2022.01); *B01F 25/31* (2022.01); *B01F 35/2111* (2022.01); *B01F 35/2209* (2022.01); *B01F 35/71805* (2022.01); *B01F 23/237613* (2022.01); *B01F 2101/48* (2022.01)

(58) Field of Classification Search

CPC ..... B01F 23/232; B01F 23/237613; B01F 25/31; B01F 35/2111; B01F 35/2209; B01F 35/71805; B01F 2101/48

USPC ..... 261/76, DIG. 42

See application file for complete search history.

(56) References Cited

U.S. PATENT DOCUMENTS

| | | | | |
|---|---|---|---|---|
| 6,030,586 | A * | 2/2000 | Kuan | C02F 1/78 4/228.1 |
| 9,205,386 | B2 * | 12/2015 | Wu | B01F 23/232 |
| 9,919,939 | B2 * | 3/2018 | Rosko | C02F 1/78 |
| 10,834,929 | B1 * | 11/2020 | Lynn | C01B 13/11 |
| 2003/0080467 | A1 * | 5/2003 | Andrews | C25B 9/19 204/252 |
| 2013/0146516 | A1 * | 6/2013 | Chen | B01F 23/232 210/192 |
| 2013/0224077 | A1 * | 8/2013 | Hinkle | A61L 2/202 422/111 |
| 2014/0299165 | A1 * | 10/2014 | Barnes | B05B 7/0483 134/36 |
| 2015/0238910 | A1 * | 8/2015 | Wu | B01F 23/2323 261/76 |
| 2015/0291457 | A1 * | 10/2015 | Wu | B01F 25/31242 210/136 |
| 2017/0240442 | A1 * | 8/2017 | Lynn | C02F 1/008 |
| 2021/0024386 | A1 * | 1/2021 | Yang | C02F 1/78 |

* cited by examiner

*Primary Examiner* — Charles S Bushey

(74) *Attorney, Agent, or Firm* — Leong C. Lei

(57) ABSTRACT

An ozone water generating device includes a housing, an ozone generator for generating ozone, and an ejector having a water inlet, a water outlet, and an air inlet. The ozone generator and the ejector are installed in the housing. An exit of the ozone generator is connected to the air inlet of the ejector. The ozone water generating device can directly output ozone water, and has a compact structure and is small in size.

8 Claims, 6 Drawing Sheets

OZONE WATER GENERATING DEVICE

BACKGROUND OF THE INVENTION

1. Field of the Invention

The present invention relates to ozone disinfection, and more particularly to an ozone water generating device.

2. Description of the Prior Art

With the improvement of people's living standards, the needs for daily disinfection are gradually increased, and the disinfection effect is required to be efficient, environmentally friendly, and free of residue. Ozone is widely used in various disinfection fields because it can purify air, sterilize, and disinfect, and has superior disinfection performance.

In public places, homes or hospitals, washing hands, cleaning fruits, vegetables and devices, etc., all need to use water flow from the faucet. Therefore, the use of ozone water from the faucet for disinfection on the above occasions can meet the different needs of users greatly.

However, there are two types of ozone faucets that can flow out ozone water.

The first type of ozone faucet is to set an air inlet on the spout of the faucet. An outlet end of an external ozone generator is connected to the air inlet of the spout through an air pipe, so that the ozone generated by the ozone generator enters the spout from the air inlet to be mixed with the water flow so as to produce ozone water. When this ozone faucet is in use, the air pipe is exposed and the aesthetics is poor. The user may touch the air pipe by accident and the air pipe may fall off, having safety risks.

The second type of ozone faucet is to set an air inlet on a water valve of the faucet. An outlet end of an external ozone generator is connected to the air inlet of the water valve through an air pipe, so that the ozone generated by the ozone generator enters the water valve from the air inlet to be mixed with the water flow so as to produce ozone water. The second type of ozone faucet overcomes the shortcomings of the first type of ozone faucet, and has good aesthetics and safety.

But for consumers, consumers need to purchase and install the above ozone faucets and corresponding ozone generators to use ozone water. This is inconvenient. Therefore, consumers hope to have an ozone water generator that can directly output ozone water. The ozone water generating device can be directly connected with the existing common faucet. In this way, consumers can use ozone water only by purchasing the ozone water generating device.

SUMMARY OF THE INVENTION

The primary object of the present invention is to provide an ozone water generating device that can directly output ozone water.

An ozone water generating device comprises a housing, an ozone generator for generating ozone, and an ejector having a water inlet, a water outlet, and an air inlet. The ozone generator and the ejector are installed in the housing. An exit of the ozone generator is connected to the air inlet of the ejector.

Preferably, a one-way valve is connected in series between the exit of the ozone generator and the air inlet of the ejector. The one-way valve is configured to control a one-way connection between the exit of the ozone generator and the air inlet of the ejector.

Preferably, the ozone water generating device further comprises a control circuit board and an air sensor. The control circuit board is electrically connected to the ozone generator and the air sensor. An air outlet end of the air sensor is connected to an entrance of the ozone generator.

Preferably, the ejector, the control circuit board and the ozone generator are installed in the housing in order from left to right. The water outlet and the water inlet of the ejector are located at front and rear sides of the ejector, respectively. Front and rear sides of the housing are formed with a water outlet connection hole and a water inlet connection hole, respectively. The water outlet connection hole and the water inlet connection hole correspond to the water outlet and the water inlet of the ejector, respectively. The entrance and the exit of the ozone generator are located at front and rear sides of the ozone generator, respectively. The exit of the ozone generator is connected to the air inlet of the ejector through an air outlet pipe. The air sensor is disposed in the housing and located in front of the control circuit board. An air inlet end and the air outlet end of the air sensor are located on left and right sides of the air sensor, respectively. The air outlet end of the air sensor is connected to the entrance of the ozone generator through an air inlet pipe. The front side of the housing is formed with an air hole. The air hole is connected to the air inlet end of the air sensor through an air inlet connector.

Preferably, the water inlet connection hole and the water outlet connection hole of the housing are fitted with a water inlet connector and a water outlet connector, respectively. The water inlet connector is inserted into the water inlet connection hole. The water inlet connector is connected to the water inlet of the ejector. The water outlet connector is inserted into the water outlet connection hole. The water outlet connector is connected to the water outlet of the ejector.

Preferably, the ozone water generating device further comprises a mounting bracket. The mounting bracket is arranged in the housing. The mounting bracket is connected to a bottom wall of the housing. The mounting bracket is configured to press the control circuit board and the ozone generator.

Preferably, the mounting bracket has a mounting cavity with upper and lower openings corresponding to the control circuit board. A left side wall of the mounting cavity is provided with an air outlet connector connected to the air inlet of the ejector. The air outlet connector is in communication with the exit of the ozone generator through the air outlet pipe.

Preferably, the air inlet connector is arranged on a front side of the mounting bracket. The air inlet connector is integrally formed with the mounting bracket.

Preferably, a left side of the housing is provided with a power switch. The front side of the housing is provided with a power supply interface. The power switch and the power supply interface are electrically connected to the control circuit board.

Preferably, the ejector has a matching groove with an opening facing upward. A working status indicator is provided in the matching groove. The working status indicator is electrically connected to the control circuit board. A top of the housing is provided with a light-pervious area corresponding to the working status indicator.

After adopting the above solutions, when water enters the water inlet of the ejector, a negative pressure is generated in the ejector and the ozone generated by the ozone generator is sucked into the ejector. The ozone sucked into the ejector is mixed with the water flowing into the ejector to form ozone water. The ozone water is then output from the water outlet of the ejector.

It can be seen from the above that the ozone water generating device of the present invention can directly output ozone water, which is convenient for people to use. Moreover, the structure of the present invention is simple, and the arrangement of components is compact, so that the present invention has the advantages of small size.

DETAILED DESCRIPTION OF THE PREFERRED EMBODIMENTS

Figure 1:
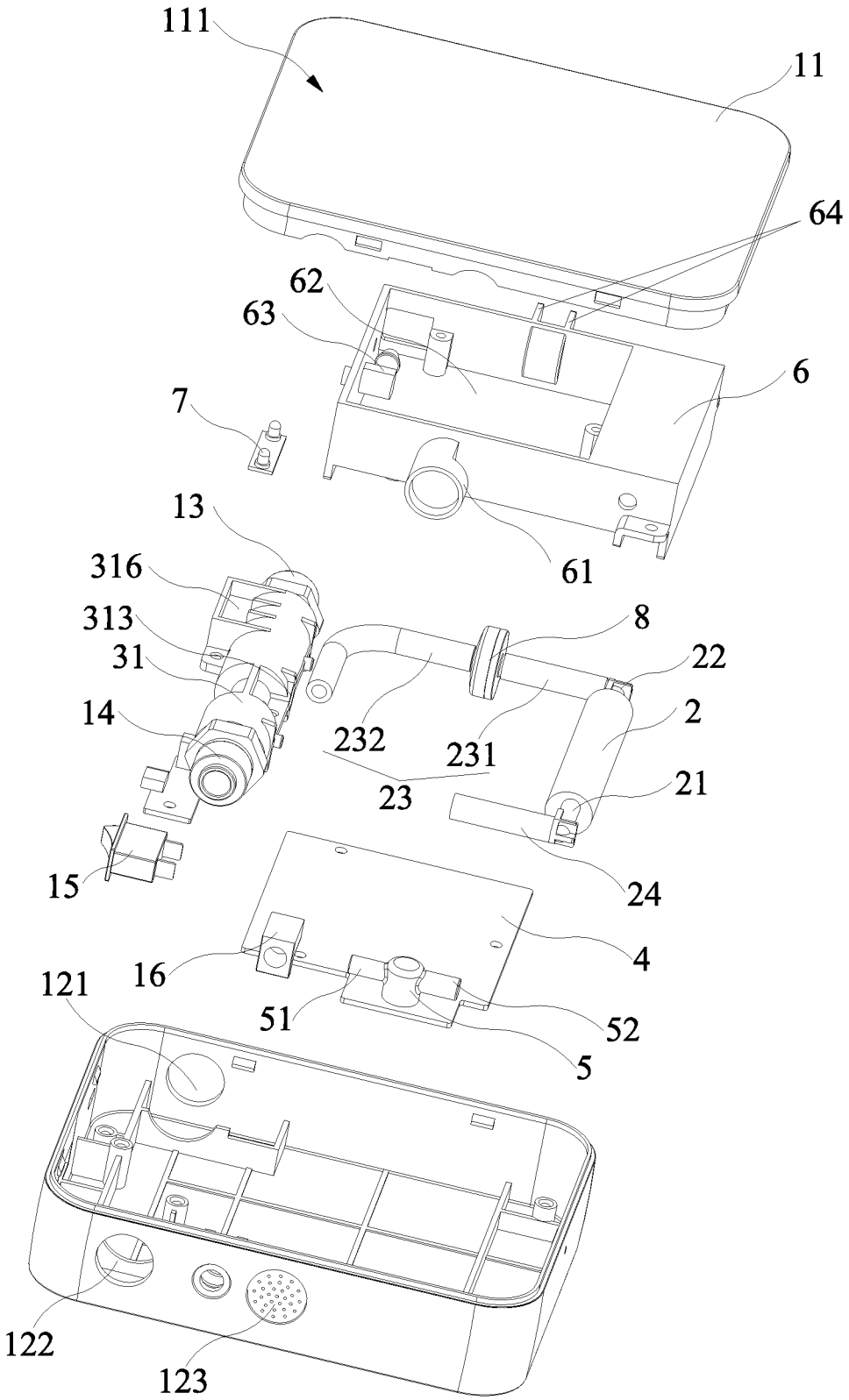
FIG. 1 is an exploded view of the present invention.

Embodiments of the present invention will now be described, by way of example only, with reference to the accompanying drawings.

As shown in FIGS. 1 to 6, the present invention discloses an ozone water generating device, comprising a housing 1, an ozone generator 2 for generating ozone, and an ejector 3 having a water inlet 311, a water outlet 312, and an air inlet 313. The ozone generator 2 and the ejector 3 are installed in the housing 1. An exit 22 of the ozone generator 2 is connected to the air inlet 313 of the ejector 3. When water enters the water inlet 311 of the ejector 3, a negative pressure is generated in the ejector 3 and the ozone generated by the ozone generator 2 is sucked into the ejector 3. The ozone sucked into the ejector 3 is mixed with the water flowing into the ejector 3 to form ozone water. The ozone water is then output from the water outlet 312 of the ejector 3. In this way, the ozone water generating device can directly output ozone water, which is convenient for people to use.

Figure 3:
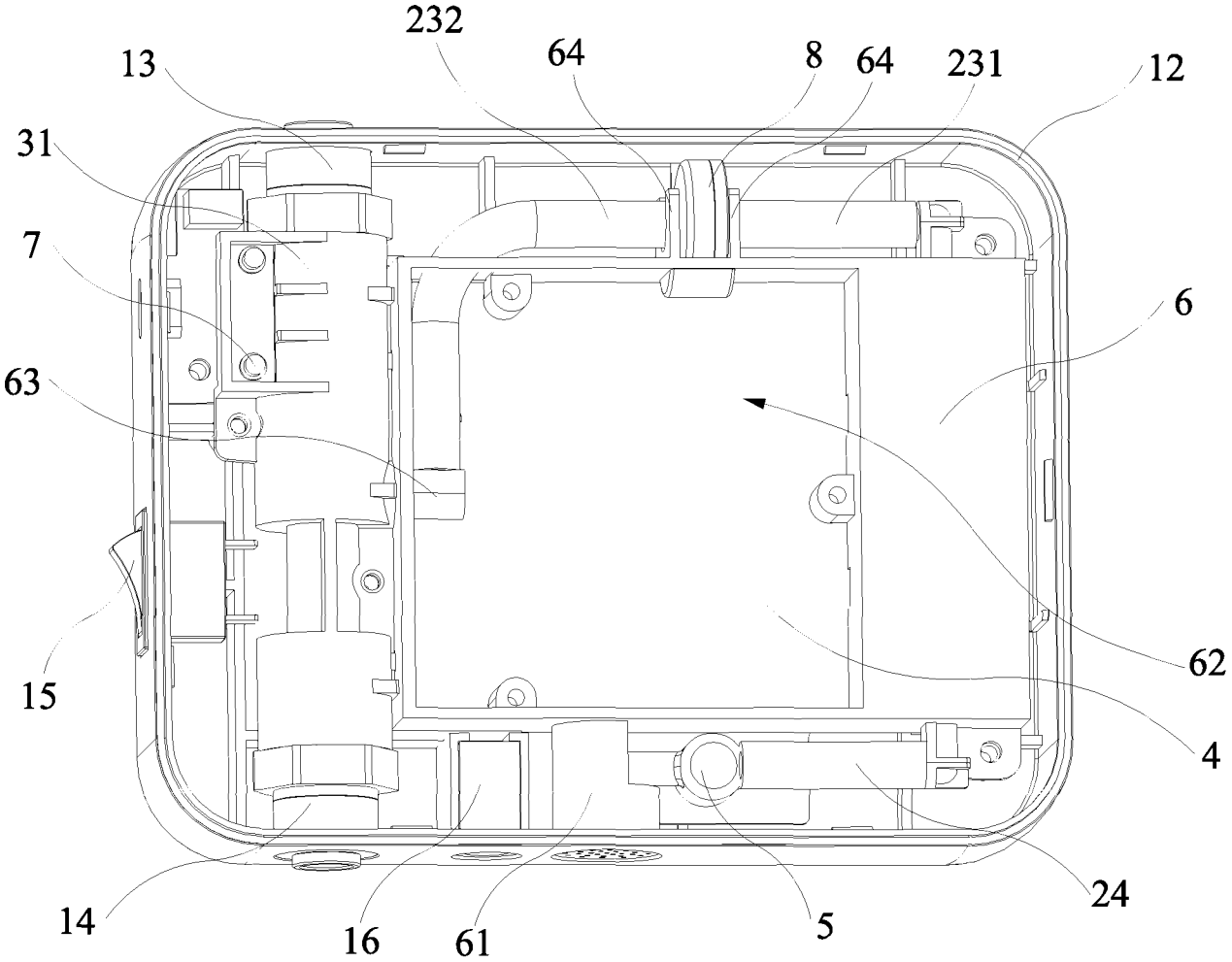
FIG. 3 is a first partial schematic view of the present invention.
Figure 4:
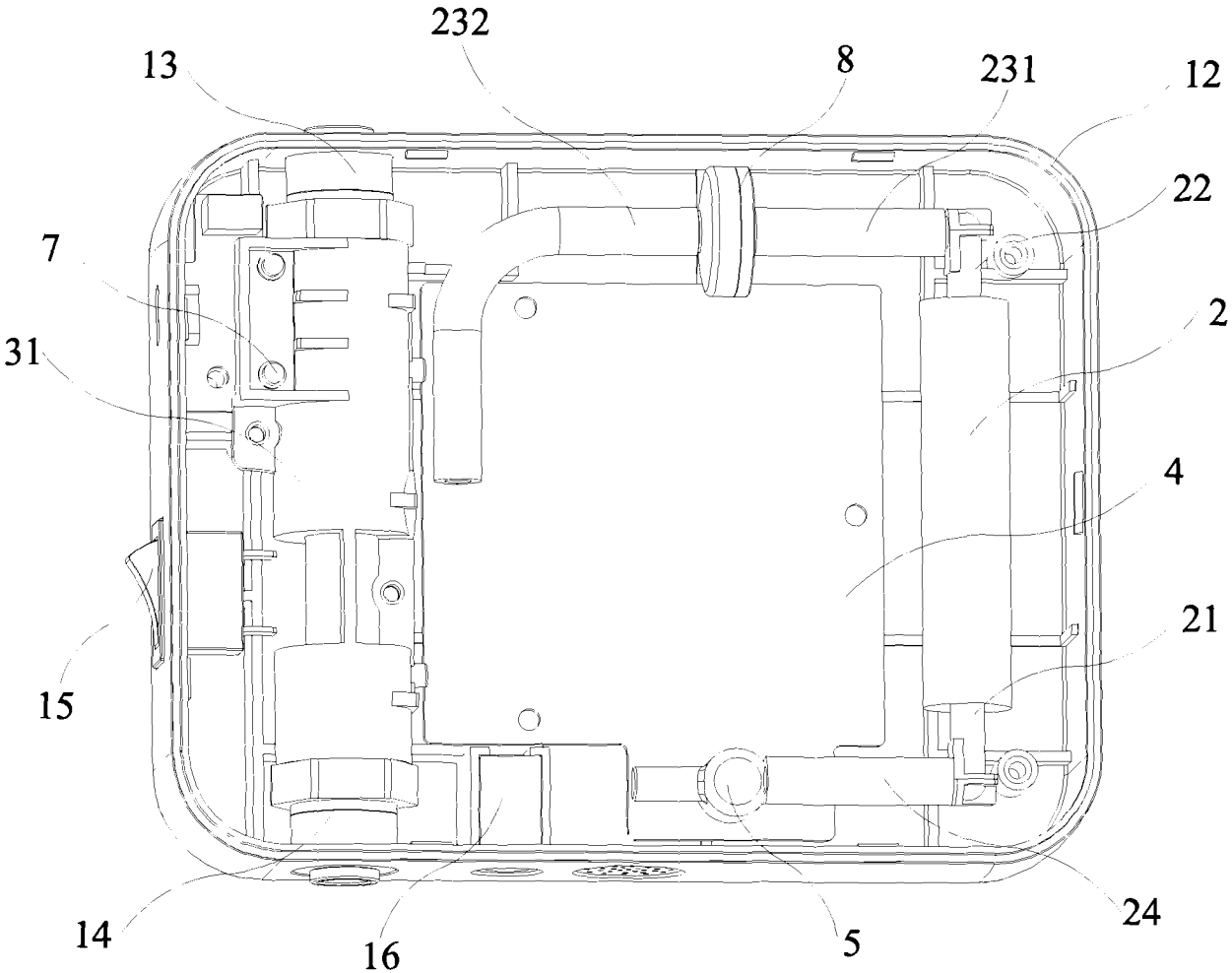
FIG. 4 is a second partial schematic view of the present invention.

As shown in FIG. 1, FIG. 3 and FIG. 4, the present invention further comprises a control circuit board 4 and an air sensor 5. An air outlet end 52 of the air sensor 5 is connected to an entrance 21 of the ozone generator 2. The control circuit board 4 is electrically connected to the ozone generator 2 and the air sensor 5. The control circuit board 4 controls the running of the ozone generator 2 according to the signal of the air sensor 5. Specifically, when water flows into the ejector 3 and generates a negative pressure, the outside air enters the ozone generator 2 through the air sensor 5. At this time, the air sensor 5 senses the passage of the air and sends a signal to the control circuit board 4, and then the control circuit board 4 controls the ozone generator 2 to run. The ozone generator 2 runs so that the air entering the ozone generator 2 reacts to generate ozone, and the ozone generated by the ozone generator 2 is then input into the ejector 3. In this way, the automatic running of the ozone generator 2 can be realized, which is convenient for use.

As shown in FIG. 3 and FIG. 4, the ejector 3, the control circuit board 4 and the ozone generator 2 can be installed in the housing 1 in order from left to right. The housing 1 is composed of an upper housing 11 and a lower housing 12. The water outlet 312 and the water inlet 311 of the ejector 3 are located at the front and rear sides of the ejector 3, respectively. The front and rear sides of the housing 1 are formed with a water outlet connection hole 122 and a water inlet connection hole 121, respectively. The water outlet connection hole 122 and the water inlet connection hole 121 correspond to the water outlet 312 and the water inlet 311 of the ejector 3 respectively, so that the water outlet 312 and the water inlet 311 of the ejector 3 are connected to an external water outlet pipe and an external water inlet pipe, respectively. The entrance 21 and the exit 22 of the ozone generator 2 are located at the front and rear sides of the ozone generator 2, respectively. The exit 22 of the ozone generator 21 is connected to the air inlet 313 of the ejector 3 through an air outlet pipe 23, so that the ozone generated by the ozone generator 21 can be sent to the ejector 3. The air sensor 5 is disposed in the housing 1 and located in front of the control circuit board 4. An air inlet end 51 and an air outlet end 52 of the air sensor 5 are located on the left and right sides of the air sensor 5, respectively. The air outlet end 52 of the air sensor 5 is connected to the entrance 21 of the ozone generator 2 through an air inlet pipe 24. The front side of the housing 1 is formed with an air hole 123. The air hole 123 is connected to the air inlet end 51 of the air sensor 5 through an air inlet connector 61. A filter 611 is provided in the air inlet connector 61, so that the air entering the air sensor 5 and the ozone generator 2 can be filtered through the filter 611.

As shown in FIG. 1 and FIG. 3, the present invention further includes a mounting bracket 6. The mounting bracket 6 is arranged in the housing 1. The mounting bracket 6 is connected to the bottom wall of the housing 1. The mounting bracket 6 is connected to the housing 1 by screws. The mounting bracket 6 is configured to press the control circuit board 4 and the ozone generator 2 to secure the control circuit board 4 and the ozone generator 2 in the housing 1. The mounting bracket 6 has a mounting cavity 62 with upper and lower openings corresponding to the control circuit board 4. The mounting cavity 62 provides an accommodating space for electronic components on the control circuit board 4. The left side wall of the mounting cavity 62 is provided with an air outlet connector 63 connected to the air inlet 313 of the ejector 3. The air outlet connector 63 is in communication with the exit 22 of the ozone generator 2 through the air outlet pipe 23. The air inlet connector 61 is arranged on the front side of the mounting bracket 6. The air inlet connector 61 is integrally formed with the mounting bracket 6, which facilitates the installation of the air inlet connector 61. Through the above arrangement of parts and components, the present invention is compact in structure and small in size.

Figure 5:
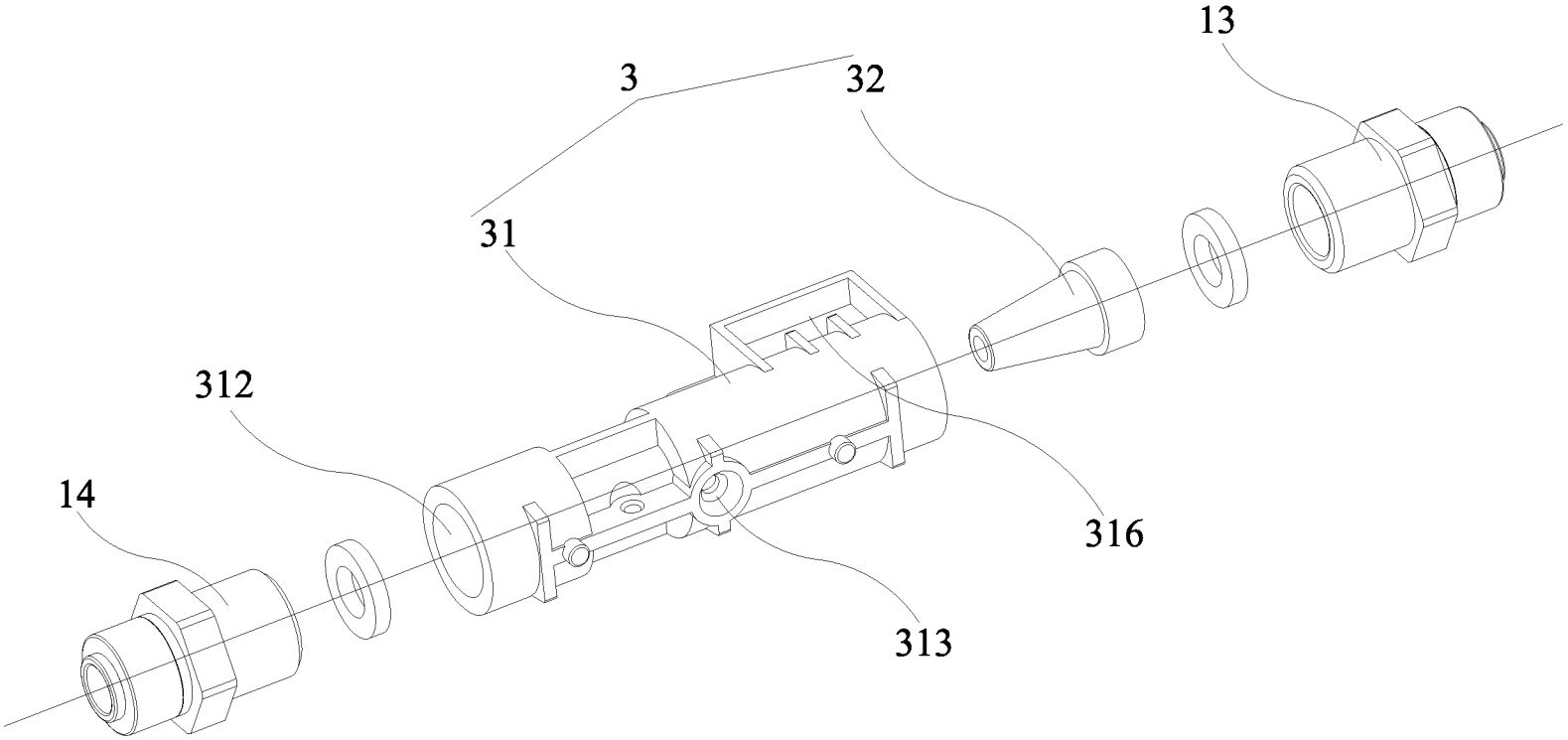
FIG. 5 is an exploded view of the ejector of the present invention.
Figure 6:
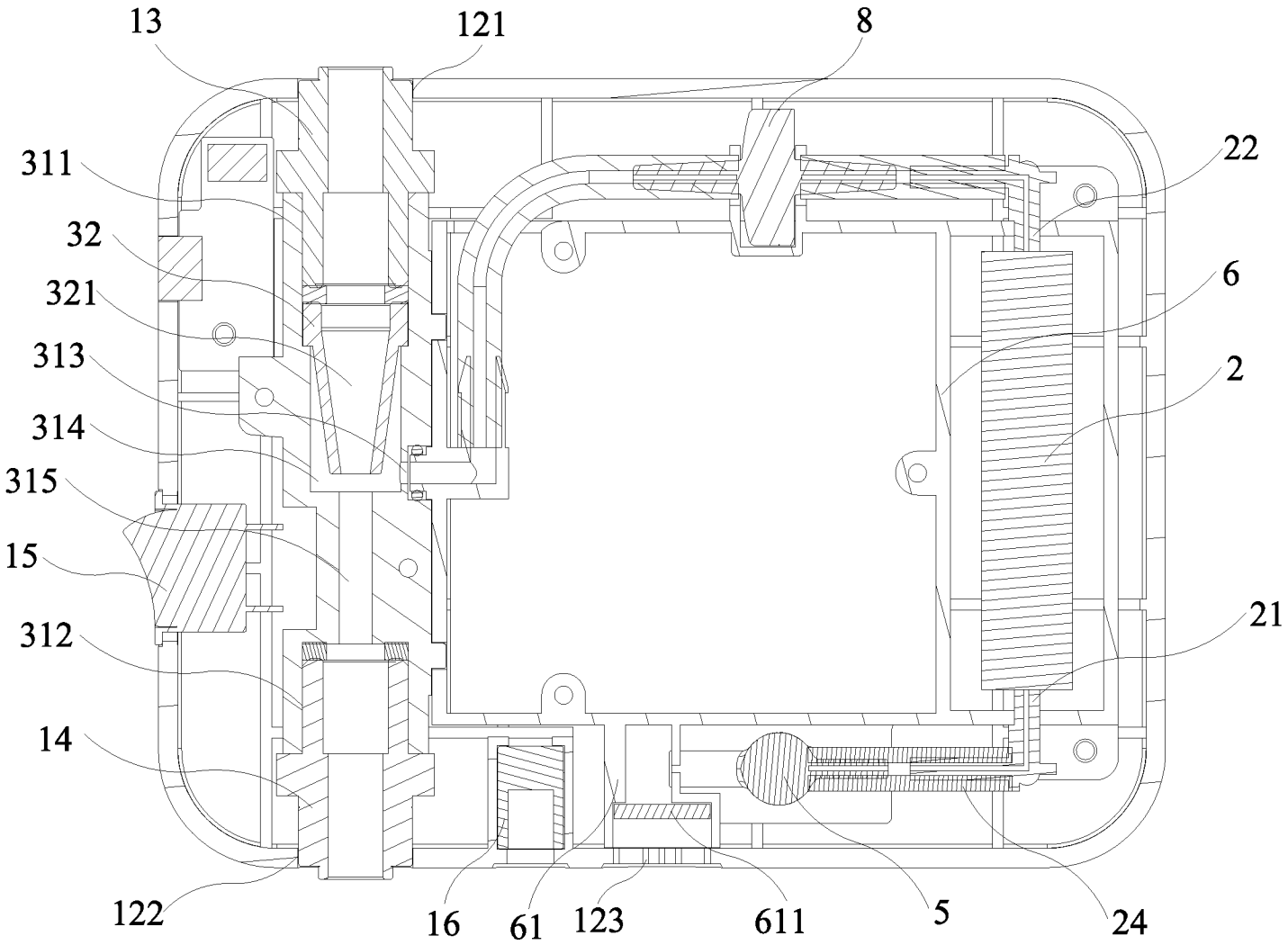
FIG. 6 is a cross-sectional view of the present invention.

As shown in FIG. 5 and FIG. 6, the ejector 3 may include a body 31 and a nozzle 32. The body 31 is connected to the lower housing 12 of the housing 1 by means of screw locking or snap-fit connection. The body 31 has a water inlet 311, a mixing cavity 314, a water outlet channel 315, and a water outlet 312 in sequence from back to front along its axial direction. The air inlet 313 of the ejector 3 is formed on the side wall of the body 31. The air inlet 313 communicates with the mixing cavity 314. The bore diameter of the mixing cavity 314 may be greater than the bore diameter of the water outlet channel 315. The nozzle 32 is inserted into the water inlet 311 and the mixing cavity 314. A spout 321 is formed in the nozzle 32. The bore diameter of the spout 321 is reduced from back to front. The spout 321 communicates with the water inlet 311 and the mixing cavity 314. The spout 321 faces the water outlet channel 315. When water enters the water inlet 311, the water is accelerated by the nozzle 32 and then injected into the mixing cavity 314.

The accelerated water flow generates a negative pressure in the mixing cavity 314, and the ozone generated by the ozone generator 2 enters the mixing cavity 314 through the air inlet 313, so that the ozone and the water flow are mixed to form ozone water. The ozone water is output through the water outlet channel 315 and the water outlet 312.

As shown in FIG. 1 and FIG. 3, the ejector 3 has a matching groove 316 with an opening facing upward. The matching groove 316 is disposed on the outer wall of the body 31. A working status indicator 7 is provided in the matching groove 316. The top of the housing 1 is provided with a light-pervious area 111 corresponding to the working status indicator 7 so that the light of the working indicator 7 can pass through the light-pervious area 111. The working status indicator 7 is electrically connected to the control circuit board 4. When the control circuit board 4 controls the ozone generator 2 to work, the control circuit board 4 controls the working status indicator 7 to light up at the same time. In this way, the user can know that the water output by the ejector 3 is ozone water when the working status indicator 7 lights up, thereby providing an indicating function.

As shown in FIG. 1 and FIG. 7, the water inlet connection hole 121 and the water outlet connection hole 122 of the housing 1 are fitted with a water inlet connector 13 and a water outlet connector 14, respectively. The water inlet connector 13 and the water outlet connector 14 are configured to connect the external water inlet pipe and the external water outlet pipe, respectively. The water inlet connection hole 121 and the water outlet connection hole 122 are disposed on the lower housing 12 of the housing 1. The water inlet connector 13 is inserted into the water inlet connection hole 121. The water inlet connector 13 is connected to the water inlet 311 of the ejector 3. The water outlet connector 14 is inserted into the water outlet connection hole 122, and the water outlet connector 14 is connected to the water outlet 312 of the ejector 3.

As shown in FIG. 1 and FIG. 3, a one-way valve 8 is connected in series between the exit 22 of the ozone generator 2 and the air inlet 313 of the ejector 3. The one-way valve 8 is configured to control a one-way connection between the exit 22 of the ozone generator 2 and the air inlet 313 of the ejector 3, so as to prevent the water flow in the ejector 3 from flowing back into the ozone generator 2. The one-way valve 8 may be arranged behind the control circuit board 4. The rear side of the mounting bracket 6 is provided with two clamping plates 64 for holding the one-way valve 8. The air outlet pipe 23 includes a first air outlet pipe 231 and a second air outlet pipe 232. The first air outlet pipe 231 is connected to the inlet of the one-way valve 8 and the exit 22 of the ozone generator 2. The second air outlet pipe 232 is connected to the outlet of the one-way valve 8 and the air outlet connector 63.

Figure 2:
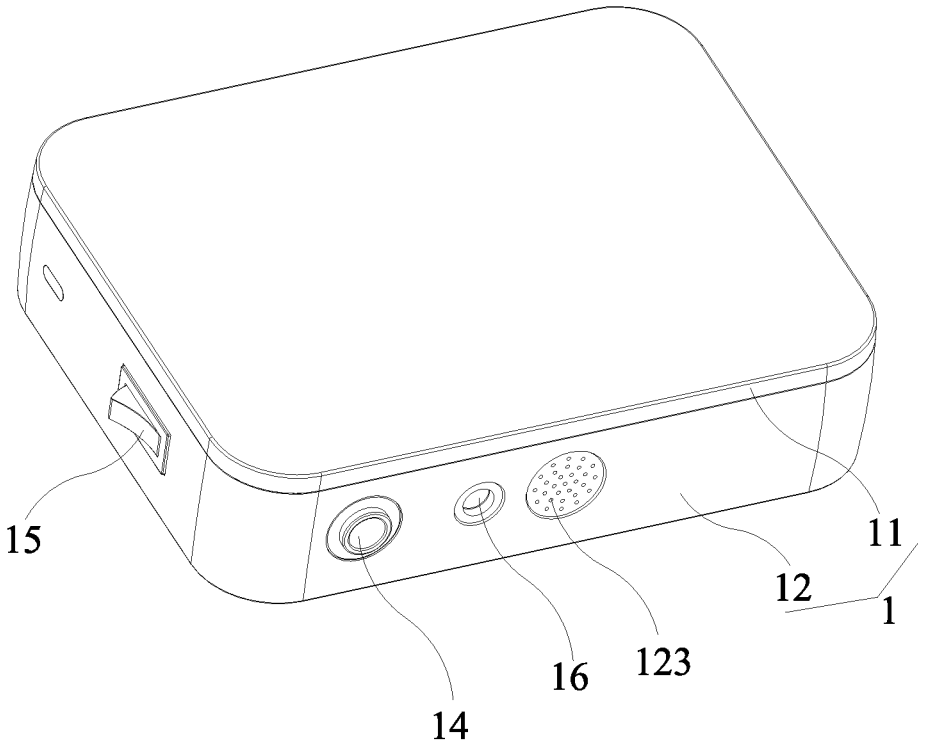
FIG. 2 is a perspective view of the present invention.

As shown in FIG. 1 and FIG. 2, the left side of the housing 1 is provided with a power switch 15. The power switch 15 is electrically connected to the control circuit board 4. The power switch 15 is configured to control the circuit board 4 to be energized or not to be energized, thereby controlling the ozone water generating device to work or not to work. The front side of the housing 1 is formed with a power supply interface 16. The power supply interface 16 is connected to the control circuit board 4, so that the control circuit board 4 can be connected to an external power supply through the power supply interface 16. The external power supply provides the power required for the running of the ozone water generating device.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. An ozone water generating device, comprising: a housing, an ozone generator for generating ozone; an ejector having a water inlet, a water outlet, and an ozone inlet; a control circuit board; and an air sensor;

wherein the ozone generator and the ejector are installed in the housing, an exit of the ozone generator being connected to the ozone inlet of the ejector;

wherein the control circuit board is electrically connected to the ozone generator and the air sensor, an air outlet end of the air sensor is connected to an entrance of the ozone generator;

wherein the ejector has a matching groove with an opening facing upward, a working status indicator is provided in the matching groove, the working status indicator is electrically connected to the control circuit board, and a top of the housing is provided with a light-pervious area corresponding to the working status indicator.

2. The ozone water generating device as claimed in claim 1, wherein a one-way valve is connected in series between the exit of the ozone generator and the ozone inlet of the ejector, and the one-way valve is configured to control a one-way connection between the exit of the ozone generator and the ozone inlet of the ejector.

3. The ozone water generating device as claimed in claim 1, wherein the ejector, the control circuit board and the ozone generator are installed in the housing in order from left to right;

the water outlet and the water inlet of the ejector are located at front and rear sides of the ejector respectively; front and rear sides of the housing are formed with a water outlet connection hole and a water inlet connection hole respectively, the water outlet connection hole and the water inlet connection hole correspond to the water outlet and the water inlet of the ejector, respectively;

the entrance and the exit of the ozone generator are located at front and rear sides of the ozone generator respectively, the exit of the ozone generator is connected to the ozone inlet of the ejector through an ozone outlet pipe;

the air sensor is disposed in the housing and located in front of the control circuit board, an air inlet end and the air outlet end of the air sensor are located on left and right sides of the air sensor respectively, the air outlet end of the air sensor is connected to the entrance of the ozone generator through an air inlet pipe; the front side of the housing is formed with an air hole, and the air hole is connected to the air inlet end of the air sensor through an air inlet connector.

4. The ozone water generating device as claimed in claim 3, wherein the water inlet connection hole and the water outlet connection hole of the housing are fitted with a water inlet connector and a water outlet connector, respectively;

the water inlet connector is inserted into the water inlet connection hole, the water inlet connector is connected to the water inlet of the ejector; the water outlet connector is inserted into the water outlet connection hole, and the water outlet connector is connected to the water outlet of the ejector.

5. The ozone water generating device as claimed in claim 3, further comprising a mounting bracket; the mounting bracket being arranged in the housing, the mounting bracket being connected to a bottom wall of the housing.

6. The ozone water generating device as claimed in claim 5, wherein the mounting bracket has a mounting cavity with upper and lower openings corresponding to the control circuit board, a left side wall of the mounting cavity is provided with an ozone outlet connector connected to the ozone inlet of the ejector, the ozone outlet connector is in communication with the exit of the ozone generator through the ozone outlet pipe.

7. The ozone water generating device as claimed in claim 5, wherein the air inlet connector is arranged on a front side of the mounting bracket, and the air inlet connector is integrally formed with the mounting bracket.

8. The ozone water generating device as claimed in claim 3, wherein a left side of the housing is provided with a power switch, the front side of the housing is provided with a power supply interface, and the power switch and the power supply interface are electrically connected to the control circuit board.

* * * * *